166-250

2/3/81 OR 4,248,300

United States Patent [19]

Braddick

[11] 4,248,300

[45] Feb. 3, 1981

[54] METHOD OF AND APPARATUS FOR POSITIONING RETRIEVABLE LANDING NIPPLE IN A WELL BORE STRING

[75] Inventor: Britt O. Braddick, Houston, Tex.

[73] Assignee: Texas Iron Works, Inc., Houston, Tex.

[21] Appl. No.: 897,034

[22] Filed: Apr. 17, 1978

[51] Int. Cl.[3] ..... E21B 23/02; E21B 47/10

[52] U.S. Cl. ..... 166/250; 166/217; 166/315

[58] Field of Search ..... 166/315, 69, 89, 217, 166/125, 117, 123, 162, 169, 242, 243, 278, 208, 115, 250, 285

[56] References Cited

U.S. PATENT DOCUMENTS

| | | | |
|---|---|---|---|
| 2,887,163 | 5/1959 | McGowen, Jr. et al. | 166/217 |
| 2,906,342 | 9/1959 | Russell et al. | 166/115 |
| 2,976,931 | 3/1961 | Daffin | 166/217 X |
| 3,329,205 | 7/1967 | Brown | 166/278 |
| 3,507,329 | 4/1970 | Stone, Jr. | 166/217 X |
| 3,818,986 | 6/1974 | Abney et al. | 166/278 X |
| 3,863,715 | 2/1975 | Yonker | 166/217 |
| 3,990,510 | 11/1976 | Decuir | 166/217 X |
| 4,083,408 | 4/1978 | Milam | 166/208 X |

*Primary Examiner*—Stephen J. Novosad

*Attorney, Agent, or Firm*—Jack W. Hayden

[57] ABSTRACT

A casing is secured in a well bore in the earth's surface. A liner is secured to the casing and extends downwardly from the casing with an upwardly open receptacle forming part of the liner and facing up in the casing. The liner is provided with a recess and a retrievable landing nipple having recess means therein is secured in the recess in the liner. A production string is arranged in the casing and sealably and slidably engages within the upwardly open receptacle. Retrievable plug means can be moved down through the production string and seated in the landing nipple therebelow to close off flow between the liner and production string for carrying out desired operations in the well bore above the plug without killing the well, or retrievable instrument means can be run through the string and seated in the landing nipple without interfering with flow from the formation. If it is desired to then shut off the formation from the well bore thereabove, retrievable plug means can be seated in the landing nipple above the retrievable instrument means.

20 Claims, 12 Drawing Figures

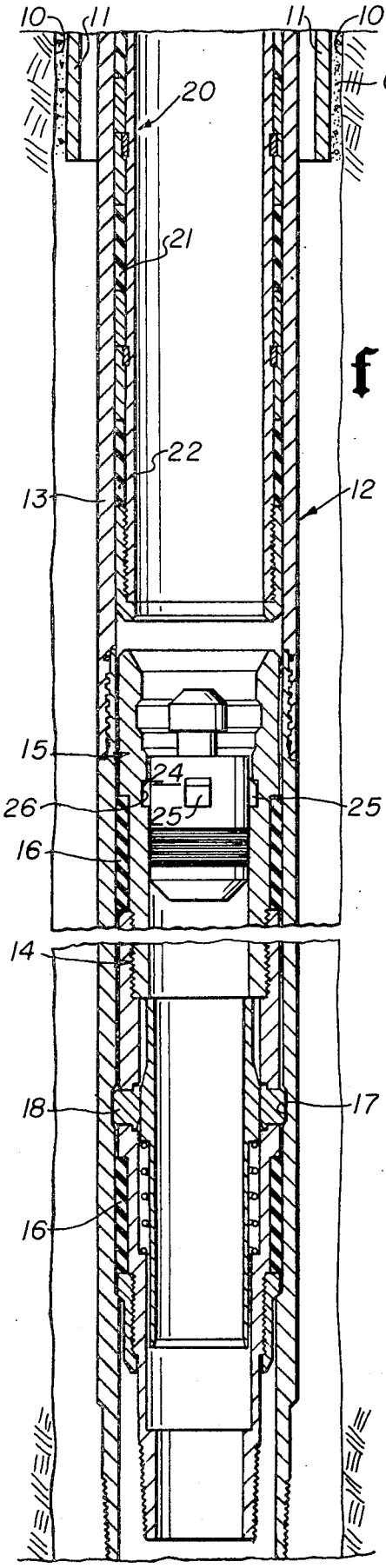
fig. 1
fig. 2
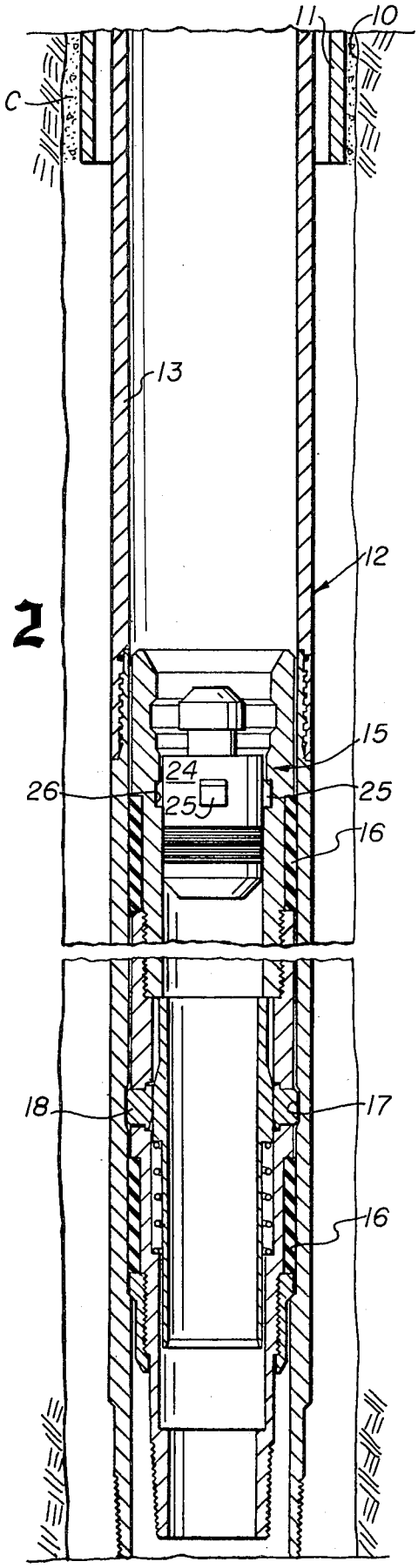

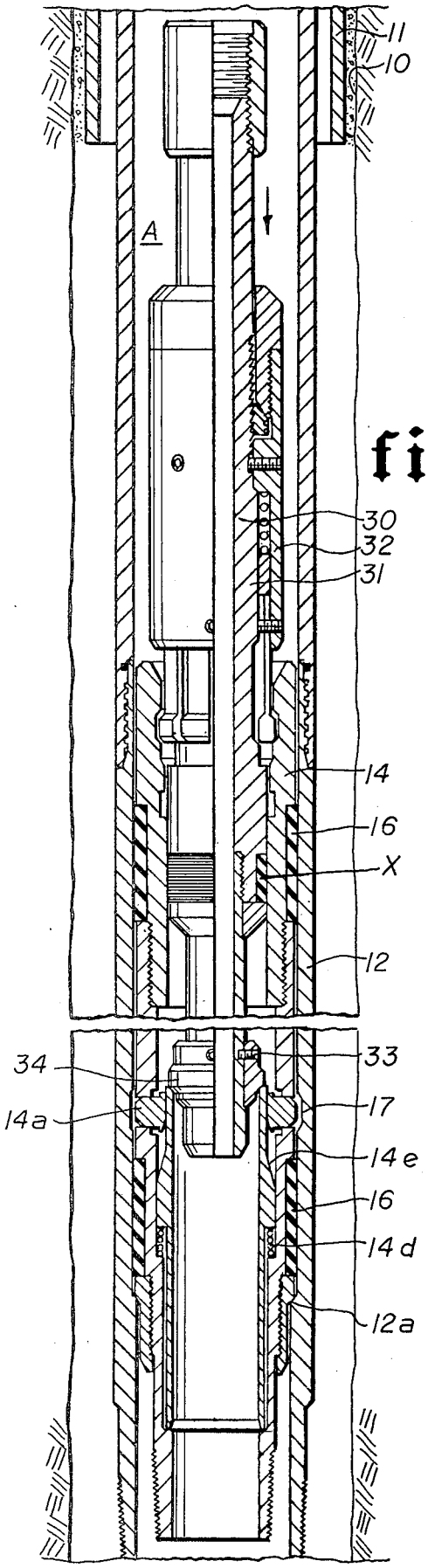
fig. 5
fig. 6
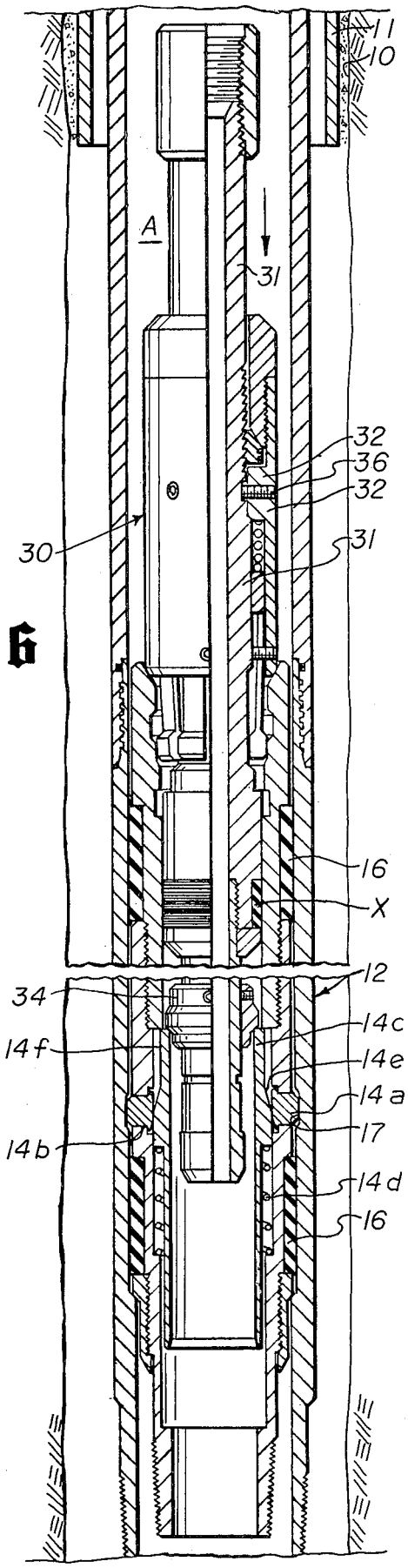

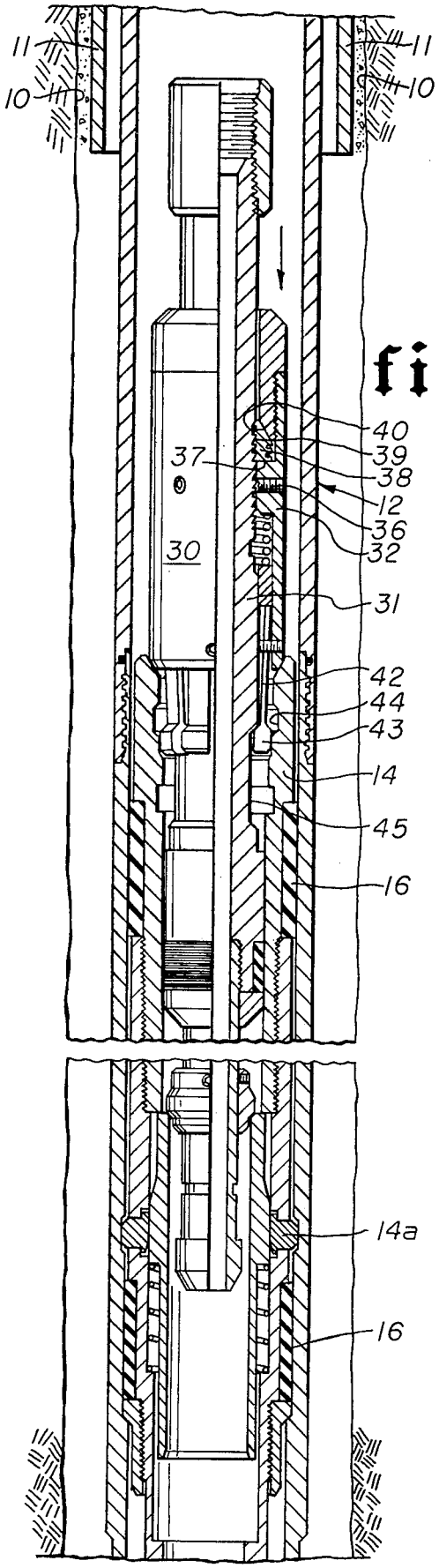
fig. 7
fig. 8
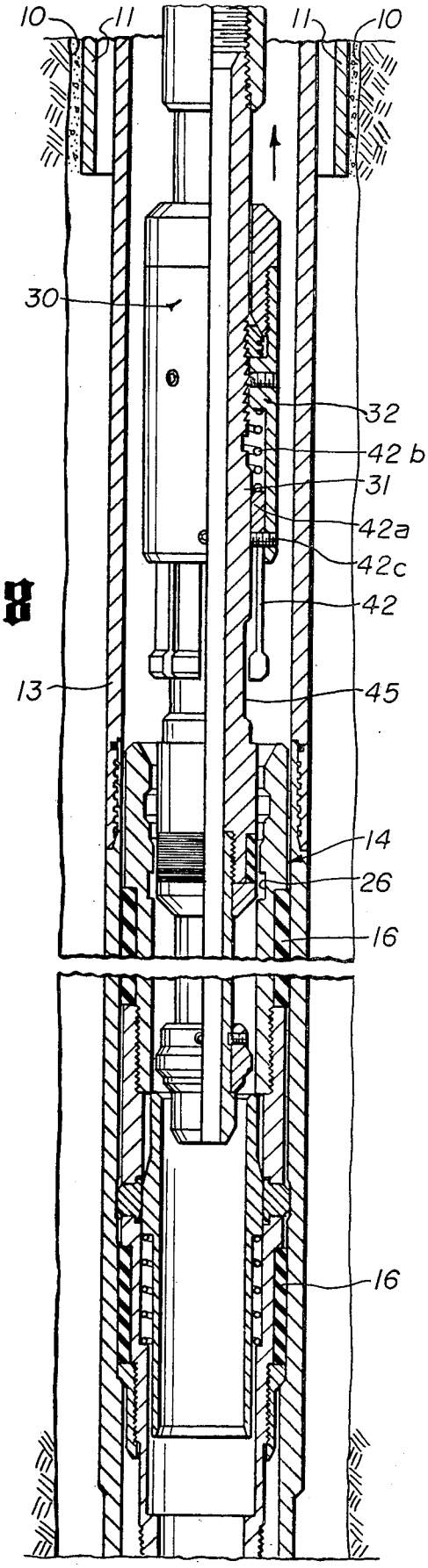

METHOD OF AND APPARATUS FOR POSITIONING RETRIEVABLE LANDING NIPPLE IN A WELL BORE STRING

SUMMARY OF THE INVENTION

It has been common practice to provide a landing nipple in a tubular member in a well bore so that a plug could be moved through the tubular member and seated in the landing nipple and thereafter removed when desired. However, there is no arrangement, so far as known to applicant, at the present time available to enable a plug to be moved downwardly through a tubular member having a smaller internal diameter (I.D.) than a liner therebelow in which the plug is to be seated. The present invention provides an arrangement whereby a plug may be moved through a tubular well string having a smaller I.D. than the portion of the well string therebelow in which the plug is to be received to close off communication into the production string above the plug. If necessary or desirable the production string can be removed from sealing engagement with the receptacle without the necessity of killing the well while desired operations are carried out in the well bore above the retrievable plug. Also, the retrievable landing nipple can be removed for access to the liner and well bore therebelow if desirable.

An object of the present invention is to provide a method of positioning a retrievable landing nipple with recess means therein in a well bore well string having a larger diameter than the diameter of a production string thereafter positioned in the well string whereby retrievable plug means may be seated in the landing nipple to block flow from the well bore to the production string comprising the steps of lowering an upwardly open receptacle into the well bore and securing it to the well string, lowering a retrievable landing nipple into and securing it in position adjacent the lower end of the upwardly open receptacle and lowering a production string into the well string and sealably engaging it within the upwardly open receptacle.

Another object of the present invention is to provide a method of positioning a retrievable landing nipple in a well bore well string which has a larger diameter than the diameter of a production string thereafter positioned in the well string whereby a retrievable plug may be moved through the production string and then seated in the landing nipple to block flow from the well bore to the production string comprising the steps of lowering an upwardly open receptacle into the well bore and securing it to the well string, lowering a retrievable landing nipple into and securing it in position in the upwardly open receptacle, lowering a production string into the well string and sealably engaging it within the upwardly open receptacle and lowering a retrievable plug through the production string to engage in the retrievable landing nipple beneath the production string for blocking flow from the well bore to the production string.

A still further object of the present invention is to provide a method of positioning a retrievable landing nipple with recess means therein in a well bore well string having a larger diameter than the diameter of a production string thereafter positioned in the well string whereby retrievable plug means and/or instrument means may be seated in the landing nipple to selectively and instrumentally measure well bore condition and/or block flow from the well bore to the production string comprising the steps of lowering an upwardly open receptacle into the well bore and securing it to the well string, lowering a retrievable landing nipple into and securing it in position adjacent the lower end of the upwardly open receptacle and lowering a production string into the well string and sealably engaging it within the upwardly open receptacle.

A still further object of the present invention is to provide a method of positioning a retrievable landing nipple with recess means therein in a well bore well string having a larger diameter than the diameter of a production string thereafter positioned in the well string whereby retrievable plug means and/or instrument means may be seated in the landing nipple to selectively and instrumentally measure well bore condition and/or block flow from the well bore to the production string comprising the steps of lowering an upwardly open receptacle into the well bore and securing it to the well string, lowering a retrievable landing nipple into and securing it in position adjacent the lower end of the upwardly open receptacle, lowering a production string into the well string and sealably engaging it within the upwardly open receptacle, and positioning retrievable plug means in the landing nipple to enable desired operations to be performed in the well bore above the receptacle including repair, replacement or modification of the equipment associated with the well string.

An object of the present invention is to provide a method of positioning and testing the seals of a retrievable landing nipple in a well bore well string having a larger diameter than the diameter of a production string thereafter positioned in the well string whereby a retrievable plug may be seated in the landing nipple to block flow from the well bore to the production string comprising the steps of lowering an upwardly open receptacle into the well bore and securing it to the well string, lowering a retrievable landing nipple into and sealably securing it in position adjacent the lower end of the upwardly open receptacle and applying fluid pressure to the sealably secured landing nipple to test for leaks.

An object of the present invention is to provide a method of positioning a retrievable landing nipple in a well bore well string having a larger diameter than the diameter of a production string thereafter positioned in the well string whereby a retrievable plug may be seated in the landing nipple to block flow from the well bore to the production string comprising the steps of lowering an upwardly open receptacle into the well bore and securing it to the well string, lowering a retrievable landing nipple into and sealably securing it in position in the upwardly open receptacle, applying fluid pressure to the sealably secured landing nipple to test for leaks and lowering a production string into the well bore and sealably engaging it within the upwardly open receptacle, lowering a retrievable plug through the production string to engage in the retrievable landing nipple beneath the production string to block flow from the well bore to the production string, elevating the production string to sealably disengage it from the upwardly facing receptacle and circulating fluid above the plug between the well string and production string.

BRIEF DESCRIPTION OF THE DRAWINGS

FIG. 1 is a vertical sectional view illustrating the casing, upwardly open receptacle, retrievable landing nipple and retrievable plug of the present invention in position in the well bore;

FIG. 2 is a longitudinal vertical sectional view with the production string of FIG. 1 withdrawn from the upwardly facing receptacle;

FIG. 5 shows the running tool actuating the landing nipple to engage it in the recess of a liner in a well bore;

FIGS. 6, 7 and 8 are longitudinal sectional views illustrating actuation of the running and retrieving tool to disengage it from the landing nipple after the landing nipple has been seated in the liner;

DESCRIPTION OF THE PREFERRED EMBODIMENT

Attention is first directed to FIGS. 1, 9–12 of the drawings wherein a well bore is represented by the numeral 10 with a casing 11 secured therein by cement C or in any other well known manner.

Figure 9:
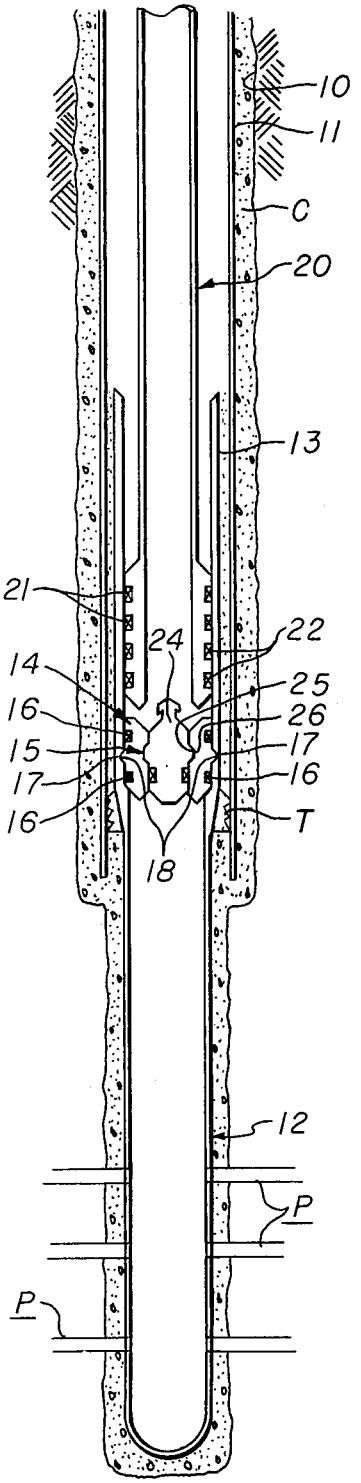
FIG. 9 is a schematic view illustrating the present invention.
Figure 10:
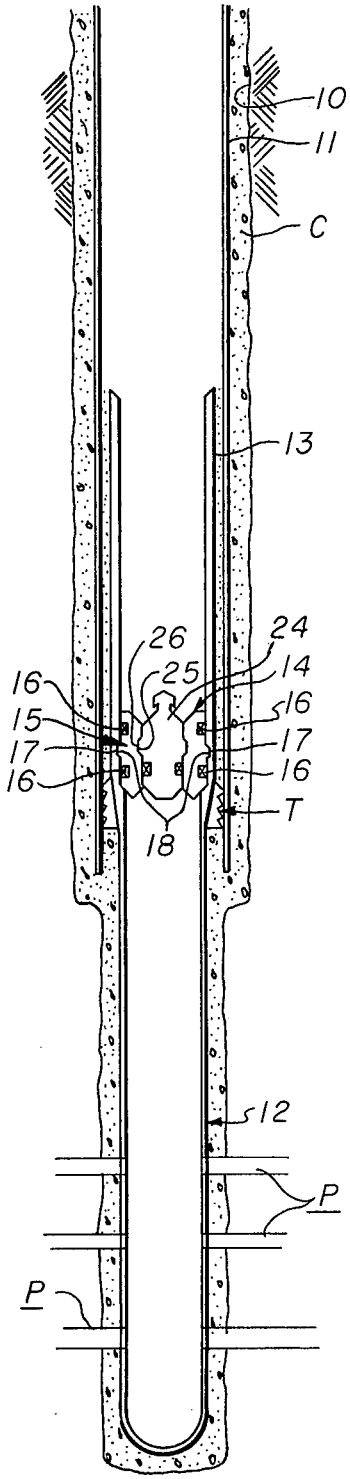
FIG. 10 is a schematic illustration of the present invention showing the production string removed from the open receptacle for circulating fluid in the well bore above the plug or for conducting other operations as may be desired.

A liner referred to generally by the numeral 12 is connected with the casing 11 by means of which is commonly called hanging the liner as shown schematically at T in FIGS. 9 and 10. The liner 12 extends downwardly from the casing 11 as shown in the drawings and includes an upwardly facing or open receptacle portion 13 which receptacle extends longitudinally within the casing 11 any desired extent. Perforations P are provided through the lower end of liner 12 and the surrounding cement C so that fluids may flow from a producing formation. The retrievable landing nipple referred to generally at 14 includes a hollow tubular body referred to generally at 15 having seal means such as illustrated at 16 for sealing between the liner 12 and the landing nipple.

Recess means 17 are provided in the liner for receiving the radially movable members 18 carried by the landing nipple to releasably secure the landing nipple 14 within the liner 12. By referring to FIGS. 9–12 it will be noted that the retrievable landing nipple 14 is seated in the liner 12 at the lower end of the upwardly facing open receptacle portion 13.

Figure 11:
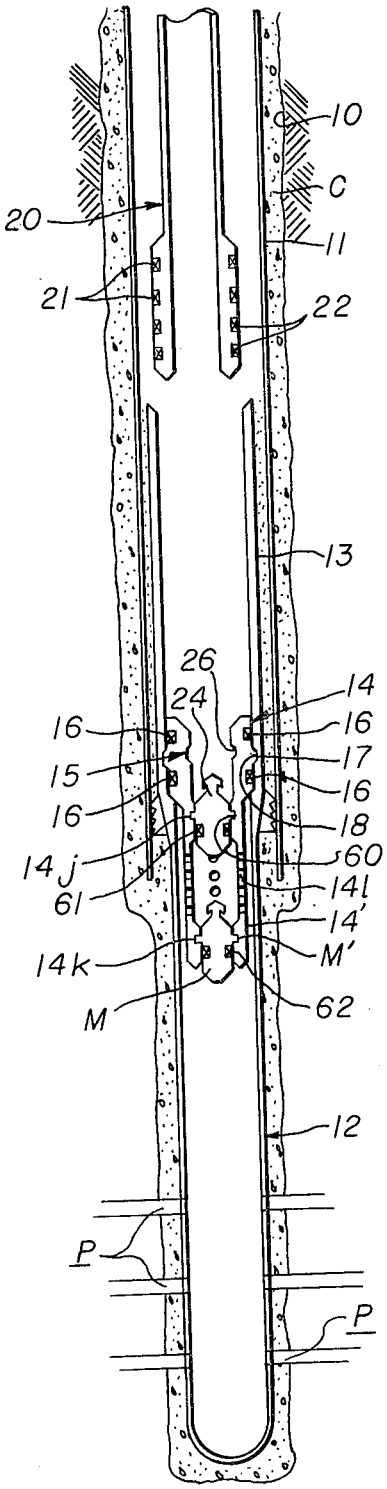
FIG. 11 is a schematic drawing showing an alternate form of retrievable landing nipple with retrievable plug means and retrievable instrument means seated therein showing the production string removed from the open receptacle for circulating fluid in the well bore above the plugs or for conducting other operations as may be desired.
Figure 12:
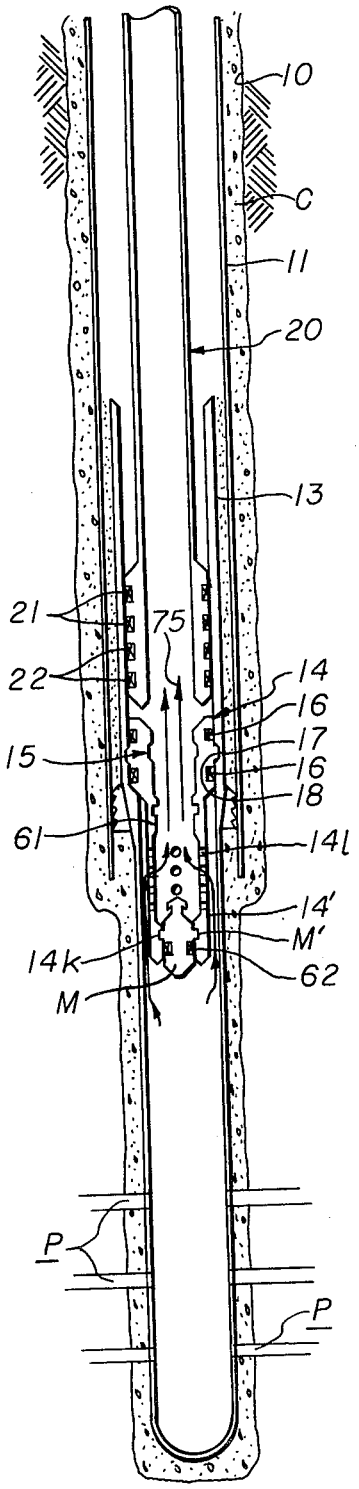
FIG. 12 is a schematic drawing showing instrument means seated in the retrievable landing nipple while flow from the formation is conducted through the nipple and to the earth's surface.

The casing 11 extends longitudinally of the well bore to the earth's surface and a production string referred to generally at 20 extends from the earth's surface and is provided with seal means 21 and 22 for slidably and sealably fitting within the receptacle portion 13 of the liner 12 above the retrievable landing nipple 14 as shown in the drawings. A plug 24 may be moved through the production string on a wire line or any other suitable lowering arrangement and is adapted to be releasably seated in the landing nipple 14 by means of the radially movable members 25 engaging in the recess 26 formed in the landing nipple. It will be noted that when the production string 20 is sealably engaged within the upwardly facing receptacle 13 as illustrated in the drawings, the inside diameter of the liner 12 therebeneath, when the landing nipple 14 is not seated therein, is larger than the inside diameter of the production string 20. Thus, it would be impossible to move a member through the production string 20 and releasably seat it in the liner 12 therebeneath having a larger diameter. However, by means of the retrievable landing nipple 14, which is seated within the liner 12 and which effectively reduces the diameter of the liner 12, the plug 24 may be lowered through the production tubing 20 and engaged in the landing nipple 14. FIGS. 11 and 12 show an alternate form of retrievable landing nipple which will be described hereinafter.

FIG. 2 is a view similar to FIG. 1 and illustrates the invention when the production tubing 20 has been withdrawn from the receptacle 13 so that circulation may be effected between the casing 11 and the production string 20 to circulate fluids above the plug 24 to accomplish desired well functions without the necessity of killing the well.

Figure 3:
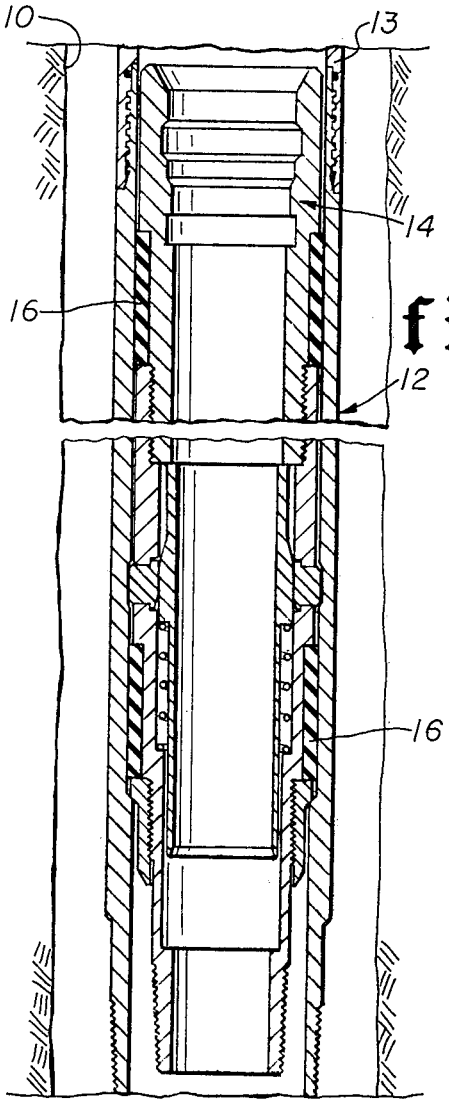
FIG. 3 is a longitudinal sectional view showing the retrievable landing nipple positioned in the liner of a well string.

FIG. 3 is a view similar to FIG. 1 but shows the landing nipple 14 in position within the liner 12 at the lower end of the receptacle 13. In use of the present invention after the casing has been set and the liner 12 secured therewith by the customary liner hanging arrangement T, the retrievable nipple 14 is then lowered through the well string to seat within the liner 12 at the lower end of the receptacle 13.

Figure 4:
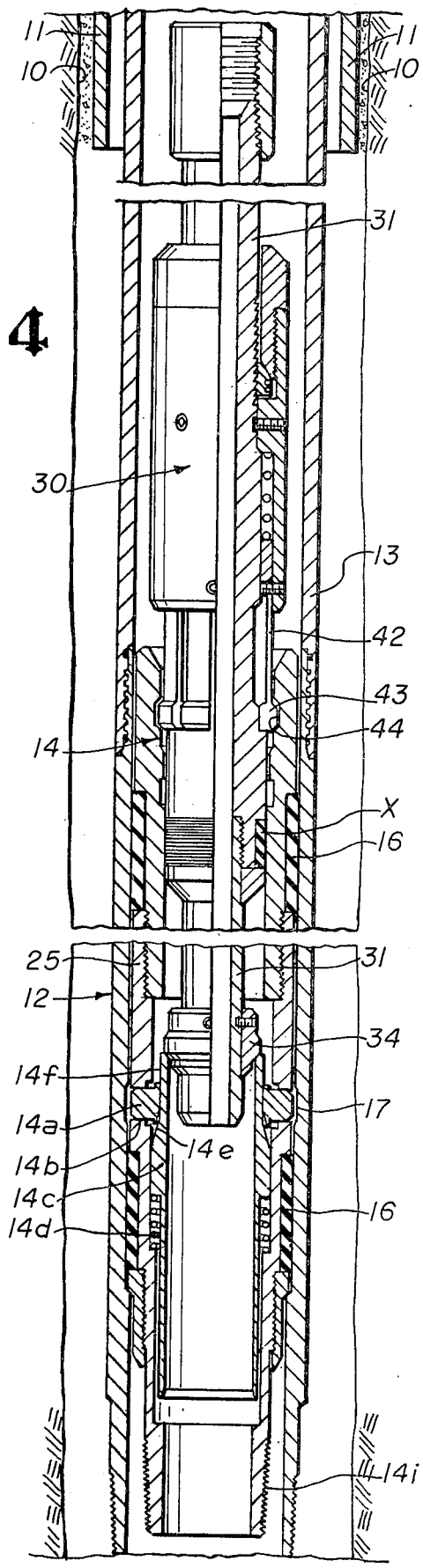
FIG. 4 illustrates the running and retrieving tool used to position the landing nipple of the present invention in the liner of the well string.

FIG. 4 illustrates a running and retrieving tool 30 with which the retrievable nipple 14 may be secured at the earth's surface and then lowered by any suitable means such as a tubular well string into the casing C or well string in the well bore so that the nipple may be positioned in releasable seating relationship within the liner 12 at the lower end of the receptacle 13 as previously described.

The retrievable landing nipple 14 includes a hollow longitudinal body 15 as previously mentioned which longitudinal body is provided with apertures 14*b* in which the members 14*a* are radially movable for engaging in the recess 17 formed in the liner 12 for seating the retrievable nipple 14 in the liner 12. A longitudinally extending annular member 14*c* is supported by spring means 14*d* within the body 15 and includes a tapered surface 14*e* and an annular surface 14*f* for actuating the members 14*a* to either retain them in retracted position as the retrievable landing nipple is lowered through the well string and liner, or to enable the members 14*a* to move radially outward to seat within the recess 17 in the liner 12. As shown in FIG. 4 the running tool 30 is arranged to engage the longitudinally extending annular member 14*c* so that the members 14*a* are positioned adjacent the cylindrical surface 14*f* to retain the members 14*a* in retracted position as the running tool 30 lowers the retrievable landing nipple in the well string.

FIG. 5 illustrates the next sequence of operation of the running and retrieving tool 30 for positioning the retrievable landing nipple 14 in the recess 17 of the liner 12. It will be noted that the retrievable running tool includes a mandrel 31 having a housing 31 thereon. When the running and retrieving tool 30 is engaged with the retrievable landing nipple 14 as shown in FIG. 4, they will move simultaneously down through the casing 11 in the well bore until the retrievable landing nipple 14 engages the shoulder 12*a* on the liner as shown in FIG. 5. When this occurs, further downward movement of the mandrel 30 causes the shear pin 33 to shear thereby releasing enlargement 34 for longitudinal upward movement on the lower end of the mandrel 31. When the pin 33 is sheared the force of the spring means 14*d* will cause the enlargement 34 to move up and at the same time the annular longitudinally extending member 14*c* will move upwardly whereupon the annular tapered surface 14*e* engages the members 14*a* and moves and maintains them radially outward in the recess 17 of the liner as illustrated in FIG. 6 of the drawings. They will remain in this position until the retrieving tool 30 moves member 14*c* against spring 14*d* so that members 14*a* can withdraw into the body 25 as the nipple is pulled out of the liner 12.

After the members 14*a* have moved radially to seat in the recess 17 to position the retrievable landing nipple 14 sealably within the liner 12 as shown in FIG. 6 of the drawings, further downward movement of the mandrel 31 relative to the housing 32 will cause the pin 36 to shear as shown in FIG. 7 of the drawings. When this occurs shoulder 37 on the housing engages the expandable lock nut 38 having one way acting rachet teeth 39 thereon which engage rachet teeth 40 on the outer surface of the mandrel 31. Upward movement of the housing 32 relative to the mandrel 31 causes the locking nut 39 to rachet up on the mandrel and to retain or lock the housing 32 in such elevated position. This upward movement will cause the circumferentially spaced, longitudinally extending members 42 having enlargements 43 thereon to disengage from the recess 44 of the retrievable mandrel 4 and to withdraw into the annular recess 45 on the mandrel 31 of the tool 30. They will be retained in this position since the mandrel 31 is retained in position relative to the housing 30 by reason of the expandable lock nut 39 threadedly engaged with the mandrel 31 as previously described.

This then permits the running and retrieving tool to be withdrawn from the retrievable mandrel 14 as illustrated in FIG. 8 of the drawings.

Thereafter the production string 20 may be lowered into the well bore and sealably and slidably engaged with the receptacle 13 on the liner 12 for receiving flow from the well bore through the liner and upwardly through the production string. Should it become necessary to perform any type of operation on the well, the plug 24 may be lowered through the production string and seated in the landing nipple by reason of the members 25 engaging in recesses 26 of the retrievable landing nipple as previously described. Thereafter, desired operations may be performed in the well bore above the receptacle including repair, replacement or modification of the equipment connected to the well string. Also, if desired the production string 20 may be elevated upwardly out of the receptacle 13 with which it is slidably engaged and into the casing annulus so that fluid may be circulated from the top of the well bore at the earth's surface down between the casing annulus and the production string to accomplish desired well operations without causing such fluids to come in contact with the producing formation in the well bore beneath the plug 24.

It will be noted that the members 42 extend downwardly from the annular member 42*a* carried between the housing 32 and the mandrel 31 of the tool 30. Spring means as illustrated at 42*b* abut the housing and the annular member 42*a* to tend to urge the longitudinally extending, circumferentially spaced members 42 outwardly of the housing 32 as shown in FIGS. 4 and 8 of the drawings. The pin 42*c* extending through the housing 32 and into the mandrel 31 prevents the member 42*a* from being pushed out from between the housing and mandrel by the spring 42*b* and also serves to maintain alignment of the members 42*b* relative to the annular reduced portion 45 on the mandrel 41.

If desired, the seals 16 on the retrievable landing nipple 14 may be tested before the running tool 30 is removed and before the production string 20 is positioned, or sealably seated, in the receptacle 13. This may be done since an annular seal X is provided on the running tool 30 which seals within the longitudinal bore formed in hollow tubular body 15 of the landing nipple 14 as shown in FIGS. 4 and 5. Fluid pressure may be applied in the annulus A between the casing C and tool 30 within the liner 12 and the pressure instrumentally noted at the earth's surface. If the applied pressure remains the same, there is no leakage between the seals 16 on the retrievable landing nipple 14 and the liner 12. If the pressure decreases, this indicates a probable leak by seals 16.

This enables the seals 16 to be tested before the expense of running and sealably seating the well string 20 in the receptacle 13, and before the running tool 30 is disengaged from the retrievable landing nipple 14.

If it is desired to remove the landing nipple 14, the production string 20 is removed from the well bore. The tool 30 is then lowered on a tubular string or other means such as a wire line so that enlargements 43 engage in recess 44 of the landing nipple. The enlargement 34 is pinned on mandrel 31 by shear pin 33 and engages member 14*c* and moves it down so that radial members 14*a* can move radially into body 25, thereby permitting 14 to be pulled out of the liner 12 to the earth's surface.

As noted previously, in FIGS. 11 and 12 the well bore is again represented by the numeral 10 with a casing 11 secured thereby by cement C or by any other suitable means in any manner well known in the art.

The liner referred to generally at 12 is connected with the casing C by means of the tie back T and the liner 12 extends downwardly from the casing into the well bore as shown in the drawings. The liner 12 includes the upwardly facing or open receptacle 13 which receptacle extends longitudinally within the casing 11 any desired extent and also is provided with perforations P for communicating with the producing formation. The production string referred to at 20 extends downwardly from the earth's surface and may be sealably engaged within the upwardly facing receptacle 13 by any suitable means such as the seals 21 and 22 as previously described. In FIG. 12, the production string 20 is shown above the receptacle 13 for conducting desired operations after a retrievable plug 24 has been seated in nipple 14. Thus, the producing formation communicating with the liner 12 by perforations P is protected as such operations are carried out.

The retrievable landing nipple referred to generally at 14 includes the tubular body 15 having seal means 16 thereon for sealing between the liner 12 and the retrievable landing nipple 14. Recess means 26 are provided therein.

The liner means 12 includes the recess means 17 for receiving the radially movable members 18 carried by the retrievable landing nipple 14 to releasably secure the retrievable landing nipple 14 within the liner 12 as illustrated in FIGS. 9–12 inclusive.

In FIGS. 11 and 12 the retrievable landing nipple 14 is shown as also including a tubular extension 14' secured thereto by any suitable means such as the threads **14*a* shown in FIG. 4. The tubular extension 14' includes recess means 14*j* and 14*k* which are spaced longitudinally from each other and from recess 26 as shown in FIGS. 11 and 12. Port means 141 are provided in extension 14 between the spaced recesses 14*j* and 14*k* to accommodate the flow of well fluids from the producing formation through perforations P and into the lower end of liner 12 beneath extension 14'** as will be described.

As shown in FIG. 11, suitable retrievable instrument means such as a pressure bomb or temperature bomb is illustrated by the letter M and is shown as including radially projecting members M' for seating in the recess **14*k***.

Retrievable plug means 24 is shown as having the radially movable members 60 thereon for engaging within the annular recess **14*j* above the instrument means M as shown in FIG. 11. When the plug means 24 is seated as shown, flow through the ports 14*f*** from the producing formation is shut off.

In FIG. 12 the invention is illustrated when it is desired to monitor the well as it produces by means such as a pressure or temperature bomb designated as M and shown as being retrievably seated in the recess **14*k* in the tubular extension 14' forming part of the retrievable landing nipple 14 by the means M'. In this condition, flow may occur from the producing formation through the ports 141 and into liner 12 and then to production string 20 sealably seated in upwardly facing receptacle 13 on the upper end of liner 12 as indicated by the arrows designated at 75**.

It will be noted that the tubular extension 14' has an internal bore of a first reduced diameter represented at 61 beneath recess means **14*j* and a second, smaller reduced diameter illustrated at 62 beneath the recess means 14*k* each of which is smaller in diameter than the bore through body 15 of the nipple 14**.

It can be seen from the foregoing that the present invention provides an arrangement whereby a retrievable seating nipple can be seated in a liner having a larger diameter than the production string which is received in the open end receptacle of the liner. This permits plug means and/or instrument means to be moved downwardly through the smaller diameter production string for seating in the retrievable landing nipple. Well operations may be performed above the retrievable landing nipple without the necessity of killing the well as would be otherwise required.

The foregoing disclosure and description of the invention are illustrative and explanatory thereof, and various changes in the size, shape, and materials as well as in the details of the illustrated construction may be made without departing from the spirit of the invention.

What is claimed is:

1. A method of positioning a retrievable landing nipple in a well bore well string having a larger diameter than the diameter of a production string positioned in the well string, whereby a retrievable device may be inserted through the production string and sealably and releasably anchored in the landing nipple comprising the steps of:

a. lowering an upwardly open receptacle into the well bore and securing it to the well string;
b. lowering a retrievable landing nipple into and sealably anchoring it in the upwardly open receptacle; and
c. lowering a production string into the well string and sealably and removably engaging it within the upwardly open receptacle above the retrievable landing nipple.

2. A method of positioning and retrieving a retrievable landing nipple in a well having a liner therein with an annular recess comprising the steps of:

a. lowering a retrievable landing nipple into and sealably anchoring it in the annular recess of the liner in the well;
b. positioning a production string having a smaller internal diameter than the liner in the well;
c. sealably and releasably engaging the smaller internal diameter production string with the liner above the anchored landing nipple;
d. disengaging the production string from the liner and retrieving it from the well bore; and
e. retrieving the retrievable landing nipple from the liner in the well.

3. A method of positioning and testing a retrievable landing nipple in a well bore well string comprising the steps of:

a. lowering a retrievable landing nipple into and sealably anchoring it in the well string; and
b. applying fluid pressure between the sealably anchored landing nipple and the well string to test for leaks therebetween.

4. A method of selectively blocking flow from a formation in a well having a tubular member whereby well operations may be carried out without killing the well comprising:

a. sealably anchoring a retrievable landing nipple to the tubular member in the well;
b. positioning a production string having a smaller internal diameter than the tubular member in the well;
c. sealably and releasably engaging the smaller internal diameter production string with the tubular member above the anchored landing nipple; and
d. lowering a retrievable plug through the production string to sealably anchor in the retrievable landing nipple beneath the production string to block flow from the formation.

5. The method of claim 4 including the step of elevating the production string to disengage it from the tubular member.

6. The method of claim 5 including the steps of:

a. sealably reengaging the production string with the tubular member; and
b. removing the retrievable plug from the well bore.

7. The method of claim 5 including the step of circulating fluid above the plug between the tubular member and production string.

8. A method of positioning and retrieving a retrievable landing nipple in a well having an upwardly facing receptacle therein with an annular recess comprising the steps of:

a. lowering a retrievable landing nipple into and sealably anchoring it in the annular recess of the upwardly facing receptacle in the well;

b. positioning a production string having a smaller internal diameter than the upwardly facing receptacle in the well;

c. sealably and releasably engaging the smaller internal diameter production string with the upwardly facing receptacle above the anchored landing nipple;

d. disengaging the production string from the upwardly facing receptacle and retrieving it from the well bore; and e. retrieving the retrievable landing nipple from the well.

9. An arrangement for receiving fluid from a well comprising:

a. casing means secured in the well;

b. a liner secured to said casing means and extending longitudinally therebelow for receiving fluid from the formation;

c. a retrievable landing nipple sealably anchored in said liner, said landing nipple having a longitudinal bore for fluid flow therethrough; and d. a production string sealably and removably engaged with said liner above said anchored retrievable landing nipple for conducting flow from the formation to the earth's surface.

10. A retrievable landing nipple adapted to be removably positioned in a recess in a tubular member for removably seating means in the tubular member including:

a. a longitudinally extending hollow body;

b. members mounted for radial movement in apertures of said body to engage in the recess of the tubular member;

c. seal means of said body for sealably engaging with the tubular member;

d. longitudinally movable means carried by said body for urging said members radially outward of said body into the recess of the tubular member; and e. said body having means for supporting the removably seated means thereon.

11. A method of completing an oil and gas well having a casing and production string; comprising the steps of:

a. positioning the casing in the well bore;

b. securing an upwardly facing receptacle with a liner thereon in the casing;

c. lowering a retrievable landing nipple and sealably seating it within the upwardly facing receptacle; and d. positioning a production string having a smaller internal diameter than said liner in the casing with its lower end sealably and removably received in the upwardly facing receptacle above the retrievable landing nipple.

12. A running and retrieving tool for releasably engaging in a recess of a retrievable landing nipple that has radially movable members for engaging in a recess in a liner to position the landing nipple in the liner comprising:

a. a hollow, longitudinally extending mandrel;

b. housing means on said mandrel;

c. cooperating means on said mandrel and housing for releasably engaging in the recess of the landing nipple to support the landing nipple on the tool, said cooperating means including:

(1) an annular member slidably carried between said housing and mandrel;

(2) circumferentially spaced, longitudinally extending members depending from said annular member and having enlargements adjacent their ends for engaging in the landing nipple recess;

(3) spring means normally urging said annular member to engage said enlargements in the recess;

(4) said mandrel having an annular recess for receiving said enlargements of said members upon relative longitudinal movement between said mandrel and housing;

(5) shear means normally retaining said mandrel and housing in one position; and (6) cooperating lock means on said mandrel and housing actuatable when said shear means have been sheared to accommodate movement of said mandrel relative to said housing in one direction to lock them in a second position in which said members are retracted into the annular recess on said mandrel.

13. A method of completing a well having a tubular member therein with an annular recess comprising the steps of:

a. lowering a retrievable landing nipple into and sealably engaging it in position in the annular recess of the tubular member;

b. positioning a production string having a smaller internal diameter than the tubular member in the well; and c. sealably and releasably engaging the smaller internal diameter production string in the tubular member above the sealably anchored retrievable landing nipple.

14. The method of claim 13 including the additional steps of:

a. disengaging the production string from the tubular member to carry out operations in the well; and b. removing the retrievable landing nipple from the well bore.

15. A well string arrangement for fluid flow in a well bore in the earth comprising:

a. a casing secured in the well bore;

b. a liner secured to said casing and extending longitudinally therebelow for receiving fluid flow in the well string arrangement;

c. said liner including an upwardly open receptacle within said casing;

d. a landing nipple removably and sealably secured in said receptacle, said landing nipple having a longitudinal bore for fluid flow therethrough; and e. a production string sealably and removably engaged with said receptacle above said landing nipple.

16. An arrangement for controlling fluid flow in a well comprising:

a. a tubular member secured in a well said tubular member having a recess therein;

b. a retrievable landing nipple sealably anchored in the recess of said tubular member;

c. a production string having a smaller internal diameter than the tubular member for conducting flow from the well; and d. means sealably and removably engaging the production string with said tubular member above said anchored landing nipple.

17. The invention in claim 16 including retrievable plug means sealably anchored in said retrievable landing nipple to block flow from the formation.

18. The invention of claim 16 wherein said retrievable landing nipple includes opening means therein for receiving fluid flow from the well bore and conducting it to the production string.

19. The invention of claim 16 including recess means within said landing nipple.

20. The invention of claim 19 wherein said recess means are spaced longitudinally with the recess means therebetween.

* * * * *